US005245787A

United States Patent [19]

Swenson et al.

[11] Patent Number: 5,245,787

[45] Date of Patent: Sep. 21, 1993

[54] CABLE GATE APPARATUS

[76] Inventors: Kermit L. Swenson, 8750 SE. 152nd, Portland, Oreg. 97236; Andrew F. Hennes, 7611 SE. Crystal Springs Blvd., Portland, Oreg. 97206

[21] Appl. No.: 872,848

[22] Filed: Apr. 23, 1992

[51] Int. Cl.[5] ..... E01F 13/00

[52] U.S. Cl. ..... 49/34; 49/25; 49/131; 49/141; 49/324; 404/9

[58] Field of Search ..... 49/25, 34, 9, 131, 324, 49/372, 141; 404/6, 9, 10; 256/1, 23, 32

[56] References Cited

U.S. PATENT DOCUMENTS

| | | | |
|---|---|---|---|
| 353,368 | 11/1886 | Miller | 49/34 X |
| 1,642,875 | 9/1927 | Fitch et al. | 49/34 X |
| 1,653,670 | 12/1927 | Sawyer | 49/9 |
| 1,692,142 | 11/1928 | Strauss | 49/9 |
| 1,692,425 | 11/1928 | Strauss | 49/9 |
| 2,295,205 | 9/1942 | Fraser | 49/9 |
| 2,392,755 | 1/1946 | Michaels | 49/141 X |
| 2,913,197 | 11/1959 | Per Börje Fondén et al. | 49/9 X |
| 4,333,268 | 6/1982 | Dumbeck | 49/34 |
| 4,509,577 | 4/1985 | Priefert | 49/34 X |
| 4,923,327 | 5/1990 | Gorlov | 49/9 X |

FOREIGN PATENT DOCUMENTS

| | | | |
|---|---|---|---|
| 672772 | 10/1964 | Italy | 49/34 |
| 1553601 | 3/1990 | U.S.S.R. | 49/49 |
| 90/05809 | 5/1990 | World Int. Prop. O. | 49/49 |

*Primary Examiner*—Peter M. Cuomo
*Assistant Examiner*—Jerry Redman
*Attorney, Agent, or Firm*—Leon Gilden

[57] ABSTRACT

A cable gate is arranged to include a plurality of spaced housings, with the first housing including a lift arm, the lift arm providing guidance for a gate cable directed therethrough, with the gate cable including a second distal end mounted to the second housing, with the first distal end fixedly secured interiorly of the first housing, with a slide member mounted upon a track to effect displacement of the cable within the first housing effecting lifting of the lift arm and the gate cable from a first lower position within a storage channel to a second horizontal position adjacent an upper distal end of each housing.

3 Claims, 5 Drawing Sheets

CABLE GATE APPARATUS

BACKGROUND OF THE INVENTION

1. Field of the Invention

The field of invention relates to gate apparatus, and more particularly pertains to a new and improved cable gate apparatus wherein the same utilizes a cable arranged for displacement from a first lowered position to a second raised position.

2. Description of the Prior Art

Gates of various types are utilized throughout the prior art, wherein expense and elaborate construction has created a prohibitive condition discouraging use of much prior art apparatus. The instant invention attempts to provide for a gate structure including a cable arranged for displacement and for automatic operation utilizing a timer device. Prior art apparatus is exemplified in U.S. Pat. No. 4,922,655 to Seal setting forth a cantilevered flexible gate that is displaced upwardly from a lowered position by pistons mounted within a subterranean configuration.

U.S. Pat. No. 4,186,521 to Hunter sets forth a gate utilizing pivoted legs for positioning the gate legs.

U.S. Pat. No. 3,854,243 to Walker sets forth a gate mechanism arranged for pivotment from a first lowered position to a second raised position utilizing a conventional rigid fence structure.

As such, it may be appreciated that there continues to be a need for a new and improved cable gate apparatus as set forth by the instant invention which addresses both the problems of ease of use as well as effectiveness in construction in an automatic operation and in this respect, the present invention substantially fulfills this need.

SUMMARY OF THE INVENTION

In view of the foregoing disadvantages inherent in the known types of gate apparatus now present in the prior art, the present invention provides a cable gate apparatus wherein the same utilizes a flexible cable displaced from a first lowered position received within a channel of an underlying support surface to a raised position providing obstruction to traffic. As such, the general purpose of the present invention, which will be described subsequently in greater detail, is to provide a new and improved cable gate apparatus which has all the advantages of the prior art gate apparatus and none of the disadvantages.

To attain this, the present invention provides a cable gate arranged to include a plurality of spaced housings, with the first housing including a lift arm, the lift arm providing guidance for a gate cable directed therethrough, with the gate cable including a second distal end mounted to the second housing, with the first distal end fixedly secured interiorly of the first housing, with a slide member mounted upon a track to effect displacement of the cable within the first housing effecting lifting of the lift arm and the gate cable from a first lower position within a storage channel to a second horizontal position adjacent an upper distal end of each housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cable gate apparatus which has all the advantages of the prior art gate apparatus and none of the disadvantages.

It is another object of the present invention to provide a new and improved cable gate apparatus which may be easily and efficiently manufactured and marketed.

It is a further object of the present invention to provide a new and improved cable gate apparatus which is of a durable and reliable construction.

An even further object of the present invention is to provide a new and improved cable gate apparatus which is susceptible of a low cost of manufacture with regard to both materials and labor, and which accordingly is then susceptible of low prices of sale to the consuming public, thereby making such cable gate apparatus economically available to the buying public.

Still yet another object of the present invention is to provide a new and improved cable gate apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
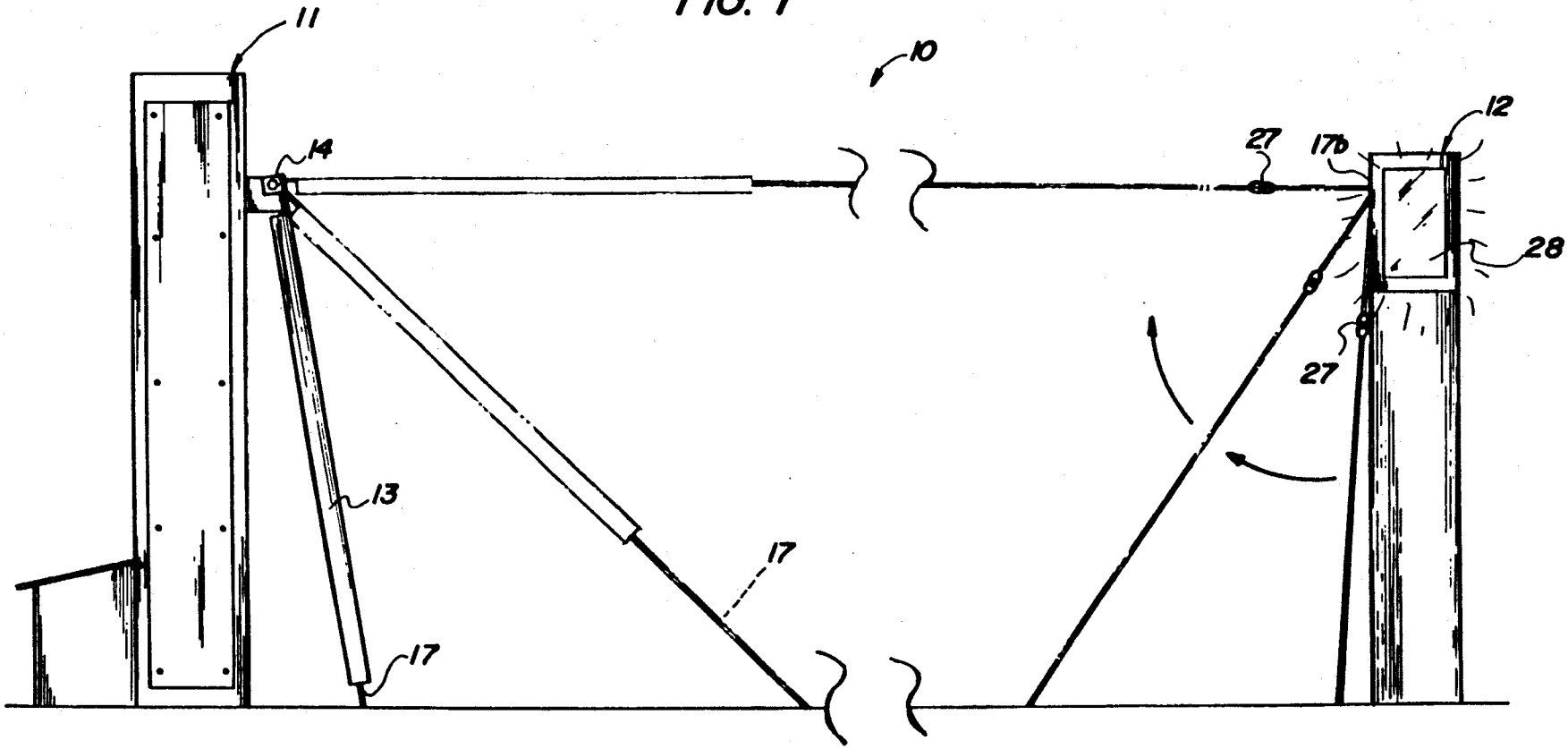
FIG. 1 is an orthographic view of the instant invention.
Figure 3:
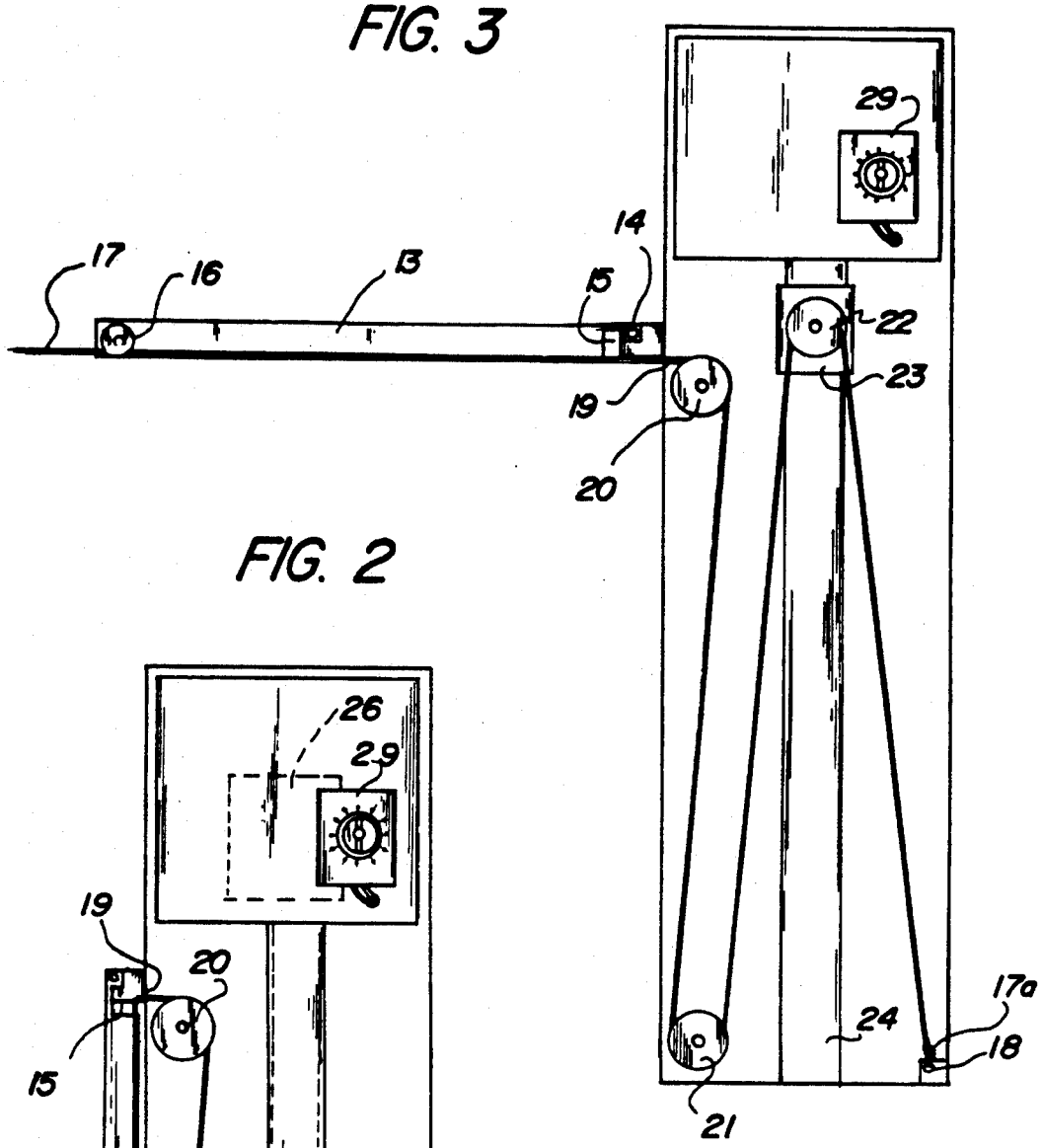
FIG. 3 is an orthographic cross-sectional illustration of the first housing in a gate raised orientation.
Figure 2:
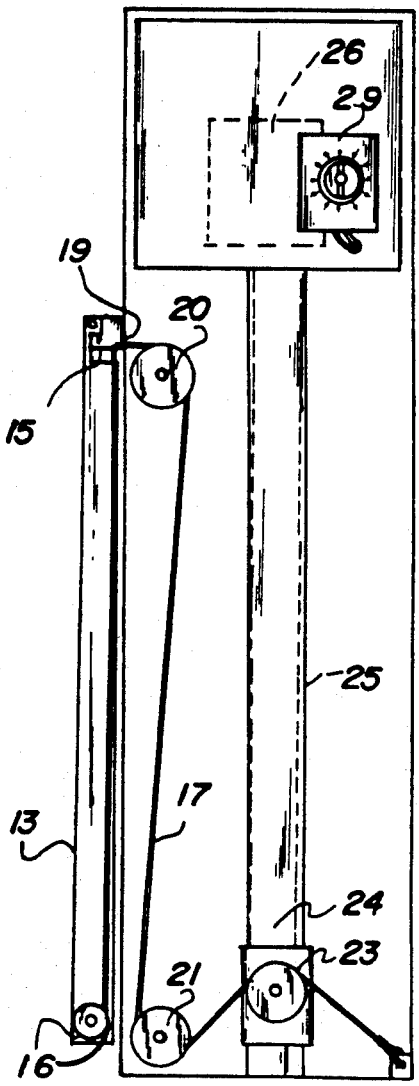
FIG. 2 is an orthographic cross-sectional illustration of the first housing in a gate lowered orientation.

With reference now to the drawings, and in particular to FIGS. 1 to 8 thereof, a new and improved cable gate apparatus embodying the principles and concepts of the present invention and generally designated by the reference numeral 10 will be described.

Figure 4:
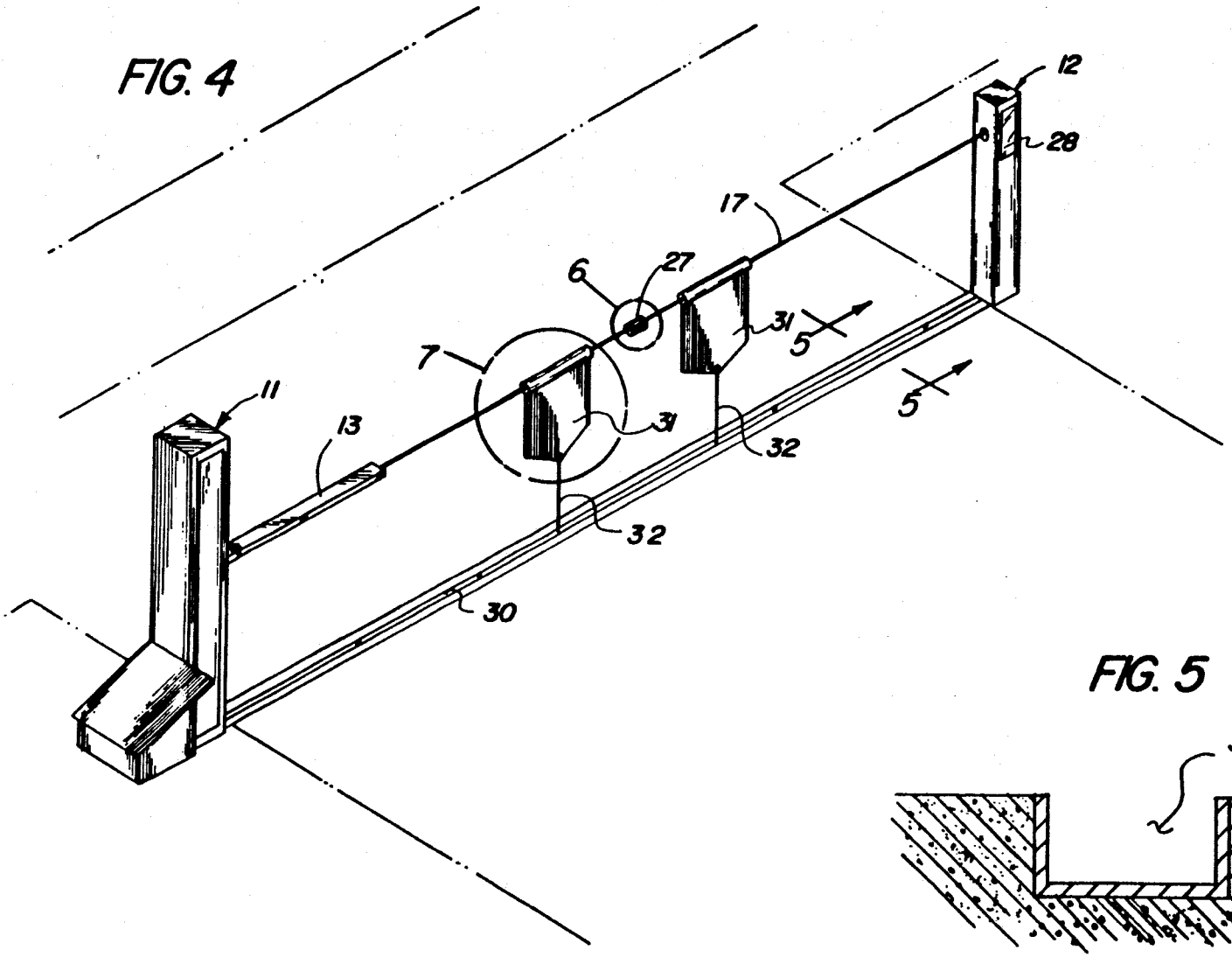
FIG. 4 is an isometric illustration of the invention employing indicator webs.
Figure 5:
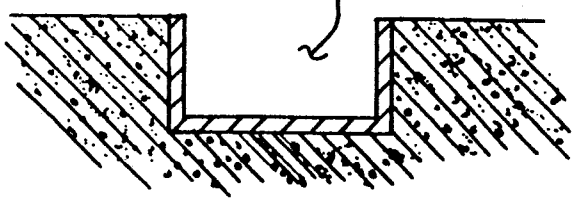
FIG. 5 is an orthographic view, taken along the lines 5—5 of FIG. 4 in the direction indicated by the arrows.
Figure 6:
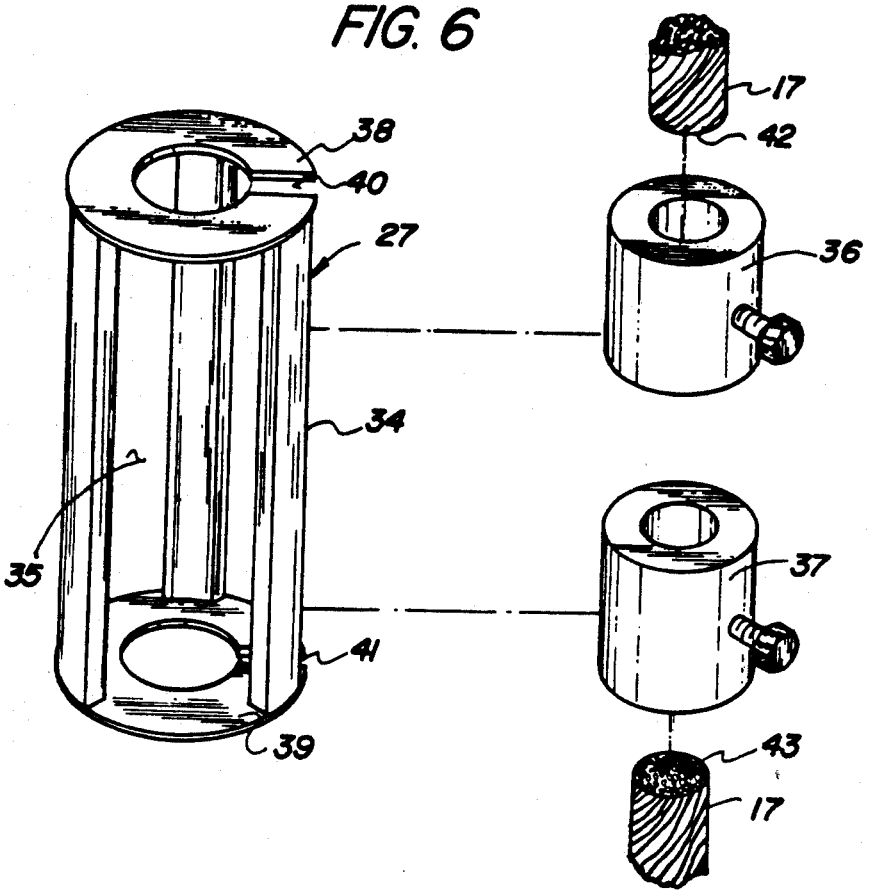
FIG. 6 is an isometric illustration of section 6 as set forth in FIG. 4.

More specifically, the cable gate apparatus 10 of the instant invention essentially comprises a first vertical housing 11 spaced from and parallel to a second vertical housing 12 defining a pathway therebetween overlying a road surface, in a manner as illustrated in FIG. 4. The first housing 11 includes a lift arm 13 pivotally mounted about a pivot axle 14 to permit pivotment of a lift arm 13 adjacent the housing 11. The lift arm includes a lift arm guide boss 15 adjacent the pivot axle and a lift arm guide pulley spaced at a remote distal end of the lift arm from the guide boss. A gate cable 17 is directed along the pulley 16 through the guide boss 15 and is formed with a cable first distal end 17*a* mounted to an anchor log 18 adjacent a floor of the first housing 11 (see FIG. 3). A second distal end 17*b* of the gate cable 17 is pivotally mounted to the second housing 12. The gate cable 17 is directed into the first housing 11 from the second housing 12 through a gate cable opening 19 that is substantially adjacent the lift arm pivot axle 14. The first housing includes a first pulley 20 positioned tangentially aligned with the gate cable opening 19 and above a second pulley 21 mounted adjacent a floor of the first housing 11. A third pulley 22 is mounted to a slide member 23 that is reciprocatably mounted within the housing, wherein the slide member 23 includes a track 24 fixedly mounted within the housing, and the slide member operative through a drive chain 25 and a motor member 26 to effect reciprocation of the slide member 23 along the track 24. It should be noted that a frangible connector 27 is mounted within the gate cable 17 between the first distal end and the second distal end 17*a* and 17*b* respectively defined by a third end portion 42 and a fourth end portion 43 (see FIG. 6 for example). The frangible connector 27 secures the third and fourth end portions 42 and 43 together to a frangible connector 27. The frangible connector 27 may be of a type as illustrated in FIG. 6 to include a frangible housing 34 defined by a cylindrical cavity 35 therethrough. A first cylindrical connector 36 mounts the third end portion 42, with a second cylindrical connector 37 mounting the fourth end portion 43, wherein the first and second cylindrical connectors 36 and 37 respectively are mounted into opposed distal ends of the frangible housing 34. A housing first end plate 38 and a housing second end plate 39 that are arranged to define a first slot 40 and a second slot 41 to receive the third and fourth end portions 42 and 43 therethrough. In this manner, the first and second cylindrical connectors 36 and 37 are coaxially aligned within the cylindrical cavity 35, whereupon inadvertent contact with the gate cable 17 by a vehicle and the like, the frangible housing 34 is broken permitting the gate cable 17 to fall between the first and second housing 11 and 12.

The second housing may optionally be provided with an illumination member 28 that is in operative communication with the drive motor 26 that is in turn controlled by a timer mechanism 29 of a desired configuration. In lieu of the timer mechanism, photo-sensitive detectors and the like may be utilized, limit switches, or any type of switch mechanism to effect actuation of the drive motor 26.

Figure 7:
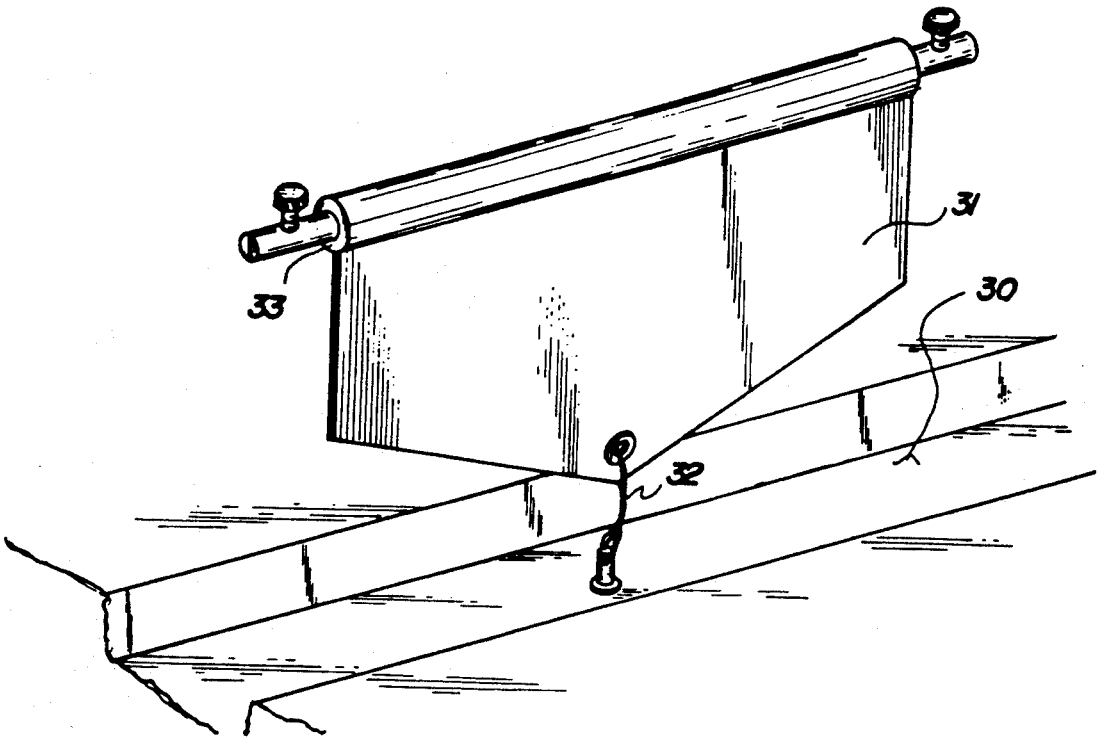
FIG. 7 is an isometric illustration of section 7 as set forth in FIG. 4.

The FIGS. 4 and 7 illustrate the use of indicator webs 31 mounted to the gate cable 17 between the first and second housings 11 and 12 that are formed with spring biased retraction cases 33 mounted to the gate cable normally biasing an indicator web 31 therewithin. Each indicator web is of a flexible construction and includes a tether line 32 mounted to a lower distal end of each indicator web, wherein the tether line is secured at one end to the indicator web 31 and at a remote end to position adjacent a storage channel 30. The storage channel 30 normally receives the gate cable 17 therewithin when the lift arm is in a lowered position minimizing damage to the gate cable during use.

Figure 8:
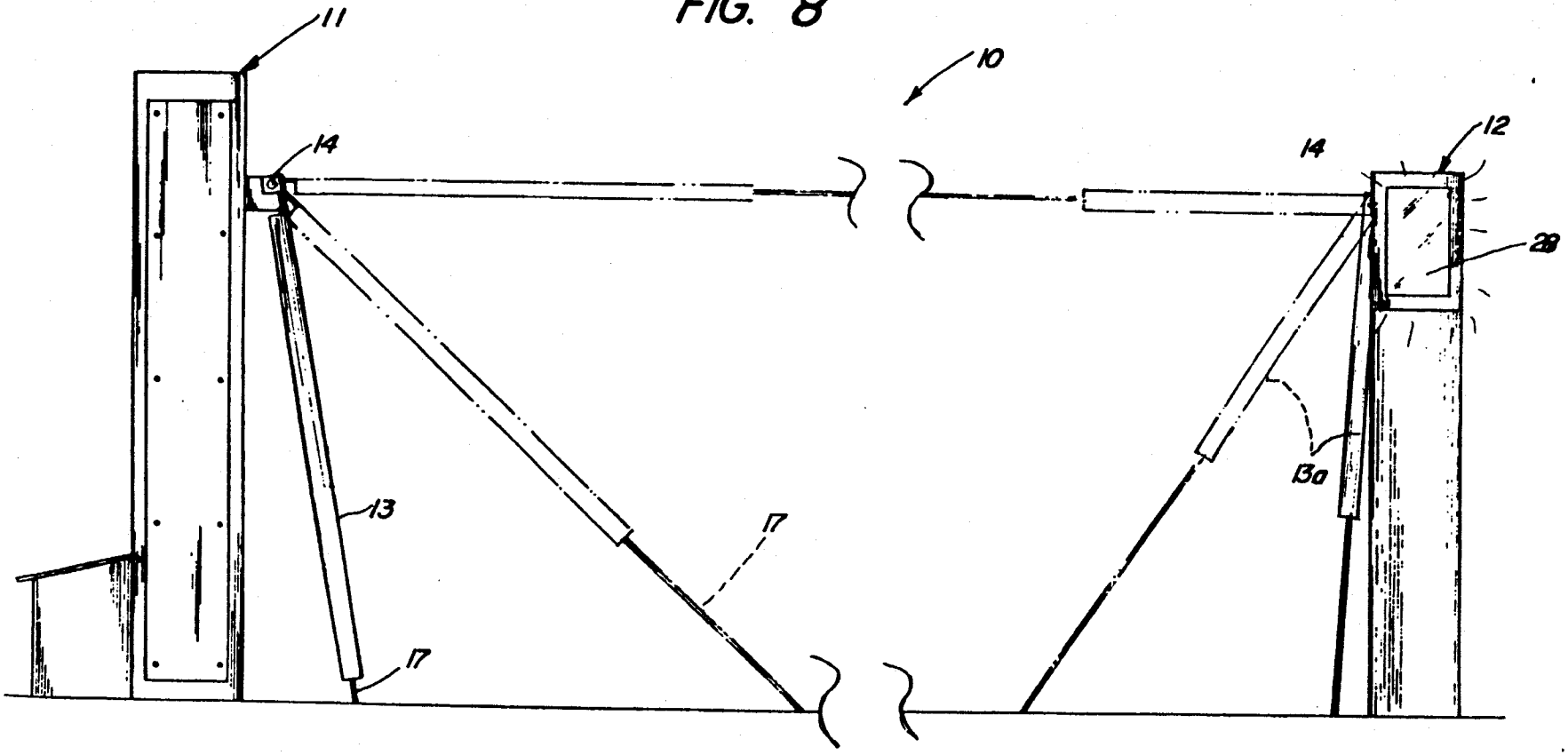
FIG. 8 is an orthographic side view of the invention illustrating the use of a further lift arm.

FIG. 8 illustrates the use of a further lift arm 13*a* pivotally mounted about a further hinge 14*a* relative to the second vertical housing 12. In this manner, the cable 17 is more positively directed into the storage channel 30 (see FIG. 4) to minimize obstruction of the cable between the first and second housings.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cable gate apparatus, comprising, a first housing spaced from a second housing, the first housing including a lift arm pivotally mounted to the first housing exteriorly of the first housing, wherein the lift arm is positioned between the first housing and the second housing, and the lift arm pivoted about a pivot axle, wherein the pivot axle is positioned exteriorly of the first housing, and the lift arm including a guide boss and a guide pulley, wherein the guide boss is positioned adjacent the pivot axle and the guide pulley is arranged in a spaced relationship relative to the guide boss adjacent a free distal end of the lift arm, and a gate cable, the gate cable including a first distal end fixedly mounted within the first housing directed through the first housing and slidably received through the guide boss and directed along the guide pulley, wherein the gate cable includes a second distal end pivotally mounted to the second housing, and drive means mounted within the first housing in cooperation with the slide member, wherein the drive means is operative for effecting displacement of the slide member within the first housing for effecting displacement of the lift arm from a first lowered position to a second raised position, and a first pulley mounted within the first housing, and a gate cable opening directed to the first housing adjacent the pivot axle, wherein the first pulley is tangentially aligned relative to the gate opening, and a second pulley mounted within the housing below the first pulley, and a third pulley mounted to the slide member, wherein the gate cable is wound about the first pulley, second pulley, and third pulley, wherein the drive means is operative for effecting displacement of the slide member from a first lowered position to position the lift arm in the first position, and the slide member displaceable to a second raised position effecting lifting of the lift arm to the second position, and the slide member is slidable about a track, the track fixedly mounted within the first housing, and the drive means including a motor member to effect displacement of the slide member along the track from the first lowered position to the second raised position, and an elongate storage channel coextensively directed between the first housing and the second housing oriented at a lower distal end of the first housing and in a lower distal end to the second housing, wherein the storage channel is arranged for reception of the gate cable when the lift arm is in the first position, and the gate cable includes a third end portion and a fourth end portion positioned between the first distal end and the second distal end, the third end portion mounted within a first cylindrical connector, and the fourth end portion mounted within a second cylindrical connector, and the first cylindrical connector and the second cylindrical connector mounted within a frangible housing, the frangible housing including a cylindrical cavity receiving the first cylindrical connector and the second cylindrical connector in a coaxially aligned relationship within the frangible housing.

2. An apparatus as set forth in claim 1 including at least one indicator web mounted to the gate cable between the first housing and the second housing, wherein the indicator web includes a spring biased retraction case mounted to the gate cable, and the indicator web formed of a flexible material, and including an indicator lower distal end, wherein the lower distal end includes a tether line mounted to the indicator web lower distal end, and the tether line further secured below the indicator web adjacent to the storage channel.

3. An apparatus as set forth in claim 2 wherein the second housing includes a further lift arm pivotally mounted relative to the second housing directing the gate cable therethrough, with the further lift arm arranged to effect directing of the gate cable within the storage channel.

* * * * *